US005993329A

United States Patent [19]

Shieh

[11] Patent Number: 5,993,329

[45] Date of Patent: Nov. 30, 1999

[54] GOLF CLUB HEAD

[76] Inventor: Tien Wu Shieh, 119, Peiping Road, Fengshan, Kaohsiung, Taiwan

[21] Appl. No.: 09/078,359

[22] Filed: May 13, 1998

[51] Int. Cl.[6] ..... A63B 53/04

[52] U.S. Cl. ..... 473/329; 473/345; 473/342

[58] Field of Search ..... 473/324, 342, 473/345, 329, 332, 346, 349, 350

[56] References Cited

U.S. PATENT DOCUMENTS 5,431,396 7/1995 Shieh .

5,433,440 7/1995 Lin .

5,467,983 11/1995 Chen .

*Primary Examiner*—Sebastiano Passaniti

*Attorney, Agent, or Firm*—Pro-Techtor International Services

[57] ABSTRACT

A golf club head includes a casing having a front opening and an inside retaining flange within the front opening, a face panel and a hollow loop-like coupling block fitted into the front opening of the casing and retained thereto by the inside retaining flange of the casing to hold the face panel in place, the coupling block having material properties of rigidness, structural strength and wear-resistance stronger than the casing but weaker than the face panel.

1 Claim, 3 Drawing Sheets

A

GOLF CLUB HEAD

BACKGROUND OF THE INVENTION

The present invention relates to golf club heads, and more particularly to a durable golf club head which effectively eliminates transmission of shock waves to the shaft of the golf club.

FIG. 1 shows a golf club head according to the prior art. This structure of golf club head comprises a casing 100 having a front recess 101, and a face panel 300 fitted into the front recess 101 in a flush manner and fixedly secured thereto by screws 200. Because the heads of the screws 200 are seen from the outside, the installation of the screws 200 obstruct the sense of beauty of the golf club head, causing the commercial value of the golf club head to be reduced. Furthermore this structure of golf club head has no buffer means to lessen shock waves, and shock waves are directly transmitted from the face panel to the shaft of the golf club through the casing. FIG. 2 shows another structure of golf club head according to the prior art. According to this design, the face panel 300 is adhered to the front recess 101 of the casing 100. Because the face panel 300 is fastened to the front recess 101 of the casing 100 by adhesive means, the impact force may overcome the binding force of the adhesive means when the face panel 300 fits the ball, causing the face panel 300 to drop from the casing 100. In either of the aforesaid two structures of prior art golf club head, shock waves are directly transmitted from the periphery of the face panel to the casing upon each hit, causing the casing to break easily at weak area X around the face panel. Furthermore, because the face panel and the casing are made from same metal material, a resonance is produced when the face panel hits the ball, and the resonance forces the casing to break easily.

SUMMARY OF THE INVENTION

The present invention has been accomplished to provide a golf club head which eliminates the aforesaid drawbacks. According to one aspect of the present invention, the golf club head is comprised of a casing having a front opening and an inside retaining flange within the front opening, a face panel, and a hollow loop-like coupling block fitted into a front opening of the casing and retained thereto by the inside retaining flange of the casing to hold the face panel in place. Therefore, a buffering space is defined within the casing behind the face panel to lessen shock waves. According to another aspect of the present invention, the coupling block has material properties of rigidness, structural strength and wear-resistance stronger than the casing but weaker than the face panel.

DETAILED DESCRIPTION OF THE PREFERRED EMBODIMENT

Figure 1:
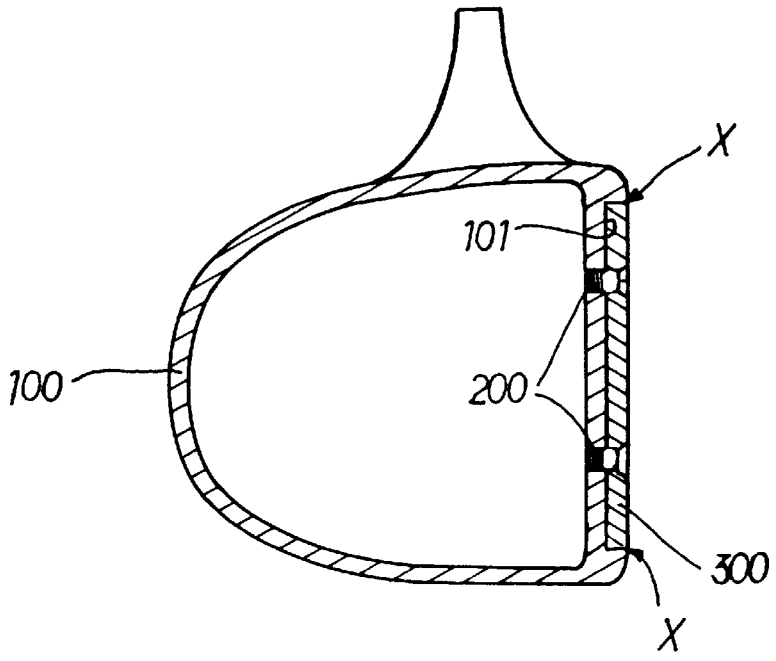
FIG. 1 (Prior Art)
FIG. 1 is a sectional view of a golf club head according to the prior art.
Figure 2:
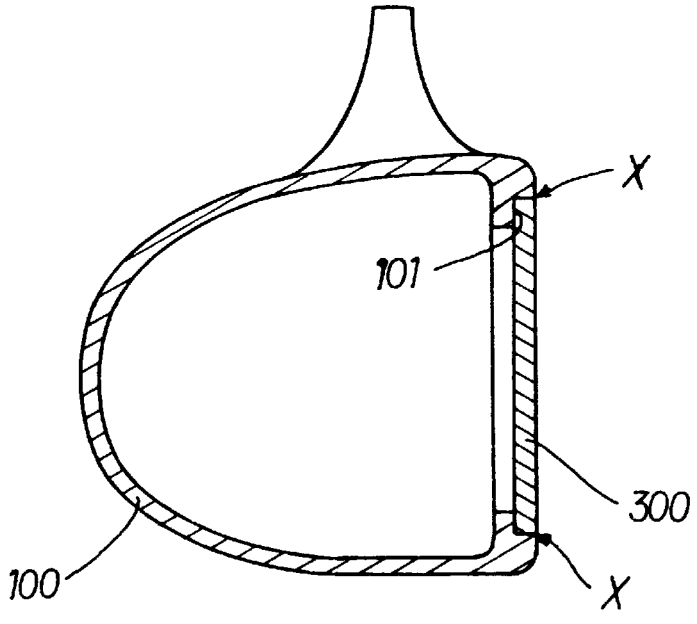
FIG. 2 (Prior Art)
FIG. 2 is a sectional view of another structure of golf club head according to the prior art.
Figure 3:
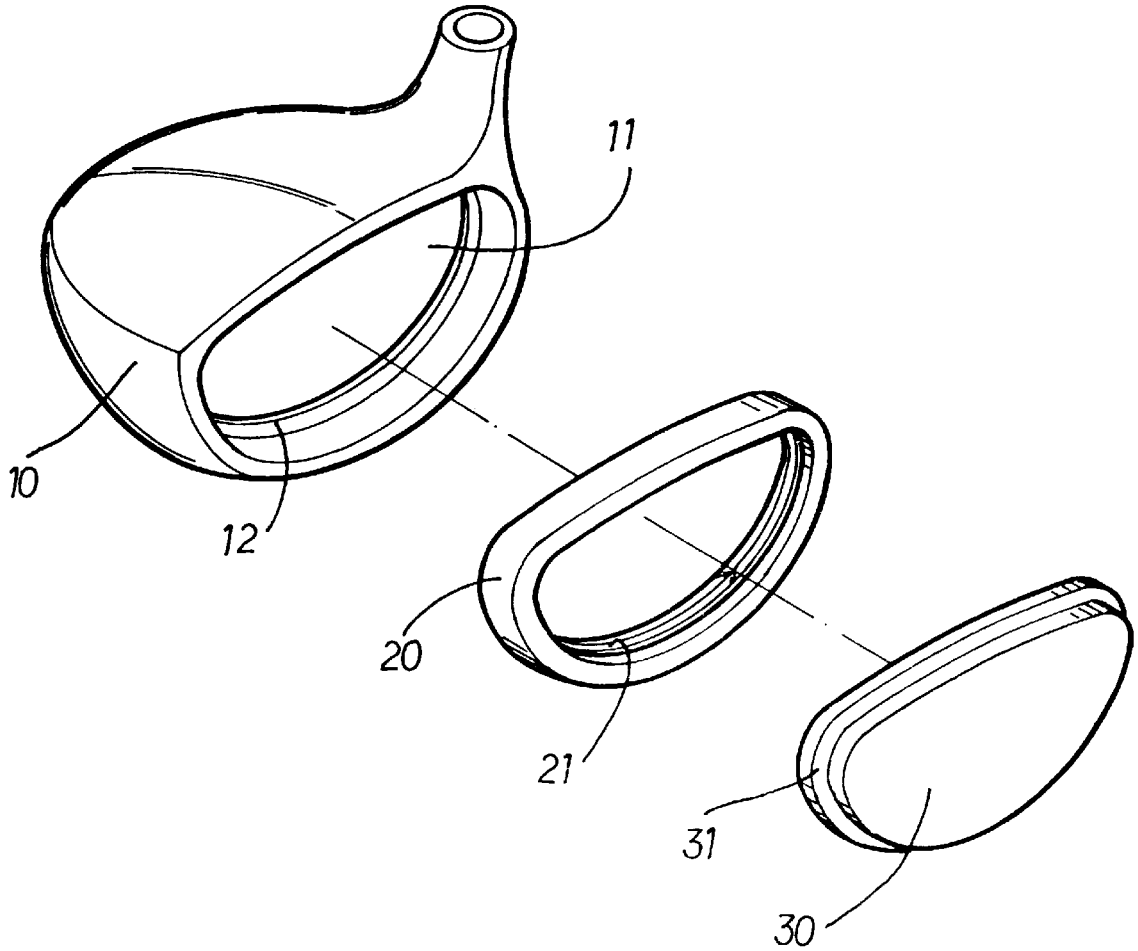
FIG. 3 is an exploded view of a golf club head according to the present invention.
Figure 4:
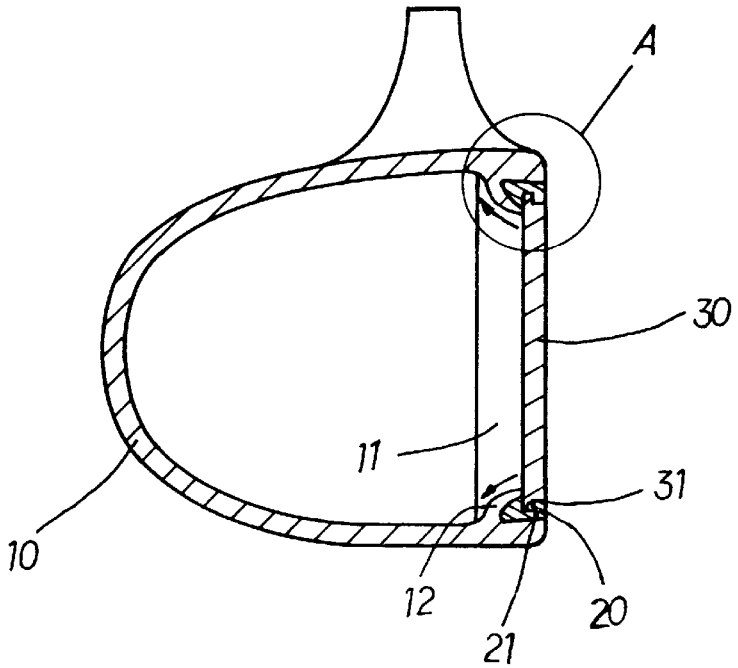
FIG. 4 is a sectional assembly view of the golf club head according to the present invention.
Figure 5:
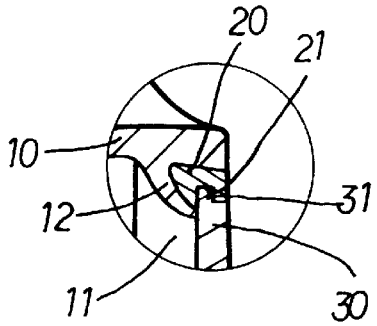
FIG. 5 is an enlarged view of part A of FIG. 4.

Referring to Figures from 3 to 5, a golf club head in accordance with the present invention is generally comprised of a casing 10, a coupling block 20, and a face panel 30. The casing 10 comprises a front opening 11, and a loop-like inside retaining flange 12 raised from the inside wall thereof around the front opening 11. The loop-like inside retaining flange 12 has an arched cross section smoothly curved outwards toward the front opening 11 (see FIGS. 4 and 5). The coupling block 20 is a hollow, loop-like, having an inside annular groove 21 raised around the inside wall. The coupling block 20 is fitted into the front opening 11 of the casing 10, and forced into engagement with the loop-like inside retaining flange 12 (see FIGS. 4 and 5). The face panel 30 fitting the inside wall of the coupling block 20, having a coupling flange 31 raised around the periphery. By engaging the coupling flange 31 into the inside annular groove 21. the face panel 30 and the coupling block 20 are fastened together. When installed, the face panel 30 is disposed in flush with the casing 10. When assembled, a high compression force is applied to the assembly to fix the casing 10, the coupling block 20 and the face panel 30 together.

As indicated above, the coupling block 20 is fitted into the front opening 11 of the casing 10 and retained in place by the loop-like inside retaining flange 12, and the face panel 30 is fitted into the coupling block 20 and secured thereto by forcing the coupling flange 31 into engagement with the inside annular groove 21. Therefore, the assembly process of the golf club head is simple without the use of any screw means or adhesive means. Because the face panel 30 is coupled to the casing 10 by the coupling block 20, a buffer space is defined behind the face panel 30, enabling the face panel 30 to curve inwards and then to return to its former shape when striking the ball, so as to lessen shock waves. Therefore, shock waves are eliminating from being transmitted to the shaft of the golf club, and a clear sound is produced upon each hit. Furthermore, because the coupling block 20 is retained to the loop-like inside retaining flange 12 of the casing 10, shock waves are evenly distributed in all directions, preventing the casing 10 from breaking. Therefore, the service life of the golf club head is prolonged.

In order to achieve a satisfactory performance, the face panel 30 is made from rigid, strong and wear-resisting alloy steel, the coupling block 20 is made from titanium, and the casing 10 is made from aluminum alloy. The material properties of rigidness, structural strength and wear-resistance of titanium alloy steel are stronger than aluminum alloy but weaker than alloy steel. When the golf club head hits the ball, the face panel 30 bears impact force first, then residual impact force is transmitted through the coupling block 20 to the casing 10 in all directions, enabling shock waves to be buffered by the buffering space defined within the casing 10 behind the face panel 30.

According to an alternate form of the present invention, the face panel 30 is made from titanium, the coupling block 20 is made from aluminum alloy, and the casing 10 is made from carbon fibers. This design achieves the same effect.

It is to be understood that the drawings are designed for purposes of illustration only, and are not intended as a definition of the limits and scope of the invention disclosed.

What the invention claimed is:

1. A golf club head comprising:

a casing having a front opening and an inside retaining flange within the front opening, said retaining flange having an arched cross-section smoothly curving outwards toward the front opening, and a face panel having a coupling flange adjacent its periphery and mounted within said front opening flush with said casing, wherein a hollow looped coupling block is fitted into the front opening of said casing and retained thereto by the inside retaining flange of said casing, said coupling block including an inside annular groove and fastened to the coupling flange about the periphery of said face panel by a tongue-and-groove arrangement, said coupling block having material properties of rigidness, structural strength and wear-resistance stronger than said casing, but weaker than said face panel.

* * * * *